US006252385B1

(12) United States Patent
Mellot

(10) Patent No.: US 6,252,385 B1
(45) Date of Patent: Jun. 26, 2001

(54) INTEGRATED START UP AND REGULATION CIRCUIT FOR A POWER SUPPLY

(75) Inventor: Pascal Mellot, Lans en Vercors (FR)

(73) Assignee: STMicroelectronics S.A., Gentilly (FR)

( * ) Notice: Subject to any disclaimer, the term of this patent is extended or adjusted under 35 U.S.C. 154(b) by 0 days.

(21) Appl. No.: 09/493,981

(22) Filed: Jan. 28, 2000

(30) Foreign Application Priority Data

Jan. 28, 1999 (FR) ..... 99 00947

(51) Int. Cl.[7] ..... G05F 3/16
(52) U.S. Cl. ..... 323/314; 323/901
(58) Field of Search ..... 323/282, 283, 323/284, 313, 314, 901; 363/49

(56) References Cited

U.S. PATENT DOCUMENTS

| | | | | |
|---|---|---|---|---|
| 5,612,610 | * | 3/1997 | Borghi et al. | 323/222 |
| 5,629,609 | | 5/1997 | Nguyen et al. | 326/269 |
| 5,798,637 | * | 8/1998 | Kim et al. | 323/313 |
| 5,955,873 | * | 9/1999 | Maccarrone et al. | 323/314 |

FOREIGN PATENT DOCUMENTS

| | | |
|---|---|---|
| 0 883 051 A1 | 6/1997 | (EP) . |
| 0 386 130 A2 | 9/1997 | (EP) . |

OTHER PUBLICATIONS

"Power Supplies", Machine Design, Jun. 1991, No. 13, Cleveland Ohio, pp. 490–509.
Holter et al., "High Temperature Integrated Voltage Regulator System Design", IEEE, Mar. 8, 1997, pp. 465–468.

* cited by examiner

*Primary Examiner*—Adolf Deneke Berhane
(74) *Attorney, Agent, or Firm*—Theodore E. Galanthay; Allen, Dyer, Doppelt, Milbrath & Gilchrist, P.A.

(57) ABSTRACT

An integrated control and regulation circuit for a power stage of a regulated power supply, includes a current generator which, when the power supply is switched on, charges a decoupling capacitor to decouple a power stage of the power supply, through a first switch. The output from a logic circuit controls this first switch, and opens it when the regulated output voltage from the power stage reaches its nominal value. Preferably, a second switch controlled by the same output from the logic circuit deactivates a regulation loop of the power stage during the start up phase and in the case of a short circuit.

48 Claims, 2 Drawing Sheets

INTEGRATED START UP AND REGULATION CIRCUIT FOR A POWER SUPPLY

FIELD OF THE INVENTION

This invention relates to control and regulation circuits for a power supply, and more particularly, to an integrated circuit, on a chip, for controlling and regulating a power stage external to the chip.

BACKGROUND OF THE INVENTION

In general, a power supply for a video device such as a camera includes a power stage, for example, having a power transistor and a decoupling and filter capacitor connected in series on a transistor emitter collector path. This power stage is composed of discrete components due to the high value (on the order of 10 $\mu$F) of the decoupling and filter capacitor, and power transistor cooling needs. A control input to the power stage, for example, the base of the power transistor, is connected to a control and regulation circuit. This circuit is preferably integrated on a chip. This circuit includes a regulation loop that receives a signal (for example a voltage) on an input, representing the value of the regulated power supply output voltage, and with an output coupled to the control input to the power stage. In a known manner, this loop reacts in order to minimize a difference between the real value of the output voltage and a theoretical voltage which is the required nominal value of the power supply output voltage.

Apart from its regulation function, this integrated control and regulation circuit also protects the power supply and powered circuits in the case of a short circuit, and limits the value of the current to a value acceptable by all elements in the circuit when the power supply is switched on. Protection against short circuits may be provided in a known manner by adding a resistor in the output circuit and by measuring the value of the voltage at the terminals of this resistor. An excessively high voltage would switch the power supply off via known circuits.

There are at least two disadvantages with this known manner of limiting the value of the current and therefore providing protection against short circuits and/or current limitations. Firstly, the voltage actually available for powered circuits is reduced by the value of the voltage drop in the resistor. This reduction varies as the value of the current output by the power supply, which causes fluctuations in the voltage actually available for circuits on the load side. Furthermore, picking up the value of the real voltage at the resistor terminals requires an additional external connection to this circuit, and it is known that the total number of connections in an integrated circuit is limited.

Another known manner of avoiding short circuits is to use a voltage comparator. The problem is to ensure that the comparison is not carried out until after the start up and stabilization phase, in order to avoid switching the power supply off immediately after it was switched on.

Furthermore, a control and regulation circuit, particularly for a camera with a port for communication with a universal standard bus (USB), includes constraints on the power supply. Thus, the current must never exceed a limiting value, for example 500 mA, particularly during start up. However, normal use may require current values of up to 300 mA. Therefore, this is a power supply in which the authorized current range is very close to the prohibited current range. The power supply must also have the normal protections against short circuits while enabling the power supply to be switched on, which (as explained above) involves two contradictory requirements.

SUMMARY OF THE INVENTION

An object of this invention is to provide a control circuit on a chip with only two connections being necessary between this circuit and elements of the power stage external to the circuit contained on the chip.

For this and other purposes, the invention is directed to a control and regulation circuit for a regulated DC power supply. The circuit is for a power stage with one control input, one input for an unregulated power supply DC voltage, one output to carry the regulated DC voltage, a decoupling capacitor connected between a constant potential source and the output from the power stage enabling a gradually regulated increase in voltage. The control and regulation circuit includes a regulation loop with an input coupled to the output from the power stage and an output coupled to the control input to this stage. Furthermore, the circuit includes a first controllable switch and a current generator connected through the first switch to the input of the control and regulation circuit connectable between the output from the power stage and the decoupling capacitor. The first controllable switch is controlled by the value of an output signal from a logic circuit with a first input for receiving a first threshold voltage value, a second input for receiving a signal representing a difference between a nominal value of the output voltage from the power stage and a real value of this output voltage. The logic circuit carries a first value of the output signal on one output corresponding to a first position of the first switch in which the first switch is closed such that the decoupling capacitor is charged by the current generator. This first value is present as long as the value of the signal representing a difference between a nominal value of the output voltage from the power stage and a real value of this output voltage received on the second input of the logic circuit is less than the value of the first threshold voltage received on the first input to the logic circuit. The logic circuit switches over to a second output value when the value of the signal representing a difference between a nominal value of the output voltage from the power stage and a real value of this output voltage becomes greater than the value of the first threshold voltage. This second value corresponds to an open position of the first switch.

In the preferred embodiment, the control and regulation circuit also comprises a second switch controllable by the logic circuit connected in the regulation loop. This second switch is open as long as the value present at the output from the logic circuit is equal to the first value, such that the regulation loop is open and the power stage does not output. This second switch is closed when the value at the output from the logic circuit is equal to the second value.

For protection against short circuits, a second value of the threshold voltage is applied to a third input on the logic circuit, and a signal representing the value of the regulated output voltage is applied on a fourth input. The output from the logic circuit is set equal to the first value and the two switches representing the position corresponding to this first value if the value of the signal present on the fourth input becomes less than the second threshold voltage applied to the third input.

BRIEF DESCRIPTION OF THE DRAWINGS

A preferred embodiment of the invention and its operation will now be explained with reference to the attached drawings, in which.

DETAILED DESCRIPTION OF THE PREFERRED EMBODIMENTS

Figure 1:
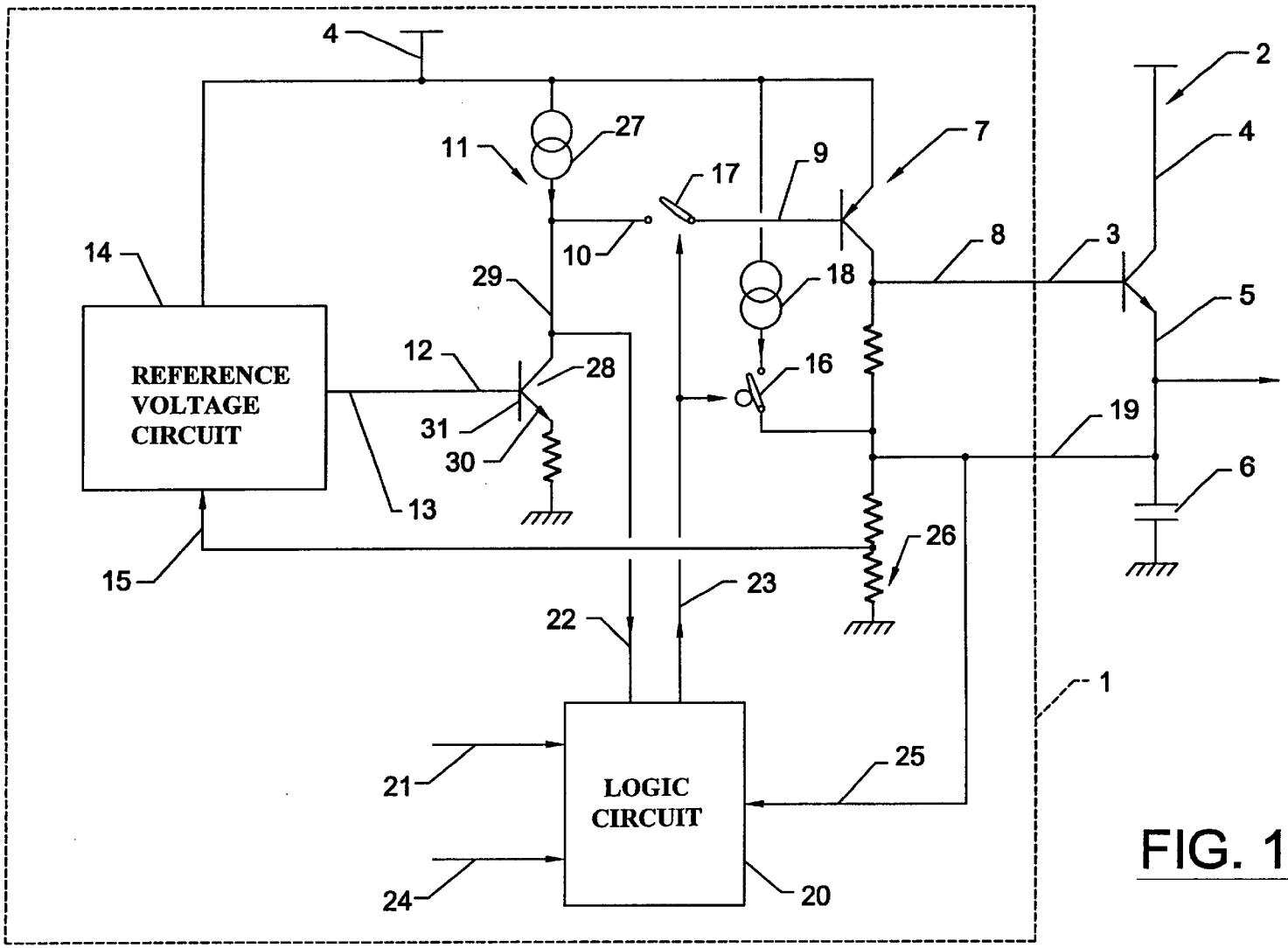
FIG. 1 shows a functional diagram of an embodiment of a circuit according to the invention.

FIG. 1 shows a start up and regulation circuit 1 for a power supply according to the invention. This circuit 1 is laid out on a chip shown in dotted lines in FIG. 1. In general, the chip will include other circuits carrying out other functions of the device in which the chip is integrated.

The circuit shown in FIG. 1 has one output 8 powering a power stage 2 which will now be described. The power stage 2, which is outside the chip comprises a power supply input 4 into which an unregulated DC voltage is input, a control input 3 and an output 5 carrying the regulated power supply voltage. In FIG. 1, the power stage 2 includes an NPN transistor in which the emitter forms the output 5 and the input 3 is connected to the base.

In a known manner, the control and regulation circuit 1 works in a closed loop receiving the value of this regulated output voltage through an input 19 connected to the output 5 from the power stage 2. This voltage is divided by a voltage divider 26 such that a fraction of this voltage is transferred to an input 15 of a reference voltage generator 14. The reference voltage generator 14 produces an error signal 13 which controls the power stage 5 through an output 8 connected to the power stage input 3, through a control stage 11 of a driver stage 7, and the driver stage 7. The voltage divider 26, the reference voltage generator circuit 14, the control stage 11 and the driver stage 7 that together form the regulation loop for the regulated voltage output from the power stage 2, are themselves known and will only be described briefly.

The voltage divider 26 is composed of two high value resistors provided in a known manner to obtain the required voltage division ratio. In the example shown, the reference voltage generator 14 is composed of a circuit commonly called a "band gap core", or a "band gap referenced biasing circuit". For example, this type of circuit and its operation are described on pages 4.181 and subsequent pages in the "Analog integrated circuits" manual by Paul R. GRAY and Robert G. MEYER, second edition published simultaneously in Singapore and in Canada by John WILEY & Sons in 1984, under number ISBN 0 471 81454.7. In a known manner, this type of circuit outputs a stable reference voltage that is a fraction of a voltage applied to an input, which is marked as reference 4 in this document, since it is the same voltage as the unregulated power supply voltage to power stage 2. The voltage divider 26 is made such that the theoretical value of the output voltage from power stage 2 divided by the division ratio of divider 26 corresponds to the value of the reference voltage output by the reference voltage generator 14. Consequently, an output 13 from the reference voltage generator 14 outputs an error signal that is applied to an input 12 on the control stage 11 of the driver stage 7.

The control stage 11 of driver stage 7 includes an NPN transistor 28 having a collector 29, an emitter 30 and a base 31. The collector 29 is connected to a current generator 27. The base 31 is connected to the input 12 of the control stage 11 of the driver stage 7. The signal applied to collector 29 forms what is commonly called the "probe" signal. The collector 29 of the transistor 28 is connected to the input 9 of driver stage 7. The driver stage 7 includes a PNP transistor, input 9 being applied to the base of this transistor, and the driver stage being powered by the output 8 from the collector.

According to a first characteristic of the invention, circuit 1 also comprises a current generator 18 connected through a first controllable switch 16 at the input 19 of the integrated circuit 1. This input 19 to the integrated circuit 1 can be connected between output 5 from power stage 2 and a terminal of a capacitor 6. The other terminal of the capacitor is connected to ground. The capacitor 6 does not form part of circuit 1. It is a regulation and decoupling capacitor of power stage 2.

According to a second advantageous characteristic of the invention, the collector 29 of transistor 28 and the input 9 of the driver stage 7 are connected through a second controllable switch 17 coupled between an output 10 from the power stage 11 and an input 9 to the driver stage 7. The operation and advantage of this controllable switch will be described later.

Switches 16 and 17 are controlled by the output value from a logic circuit 20. This output value is present on an output 23 from logic circuit 20. The logic circuit 20 also receives a value of a first threshold voltage on a first input 21, the "probe" signal from the control stage 11 of the driver circuit 7 on a second input 22, a value of a second threshold voltage on a third input 24, and finally a signal representing the value of the regulated output voltage from the power stage 2, on a fourth input 25. This value is received through the input 19 to the control and regulation circuit 1.

Circuit 1 operates as follows: under steady state operation, the regulation loop operates in a known manner to continuously restore the real value of the input voltage to the required theoretical value. Additions according to the embodiment of the invention apply to the transient condition during the start up phase and protection against short circuits. As mentioned above, during start up there is a very high charging current to charge the regulation and filtering capacitor 6, whereas the operating voltage is still below its nominal or theoretical value. This operating mode could easily be interpreted as operation in short circuit and trigger a short circuit protection, switching the power supply off. This results in "hick-up" or pumping type operation in which the power supply hick-ups before reaching its stable condition. This dysfunction mode occurs particularly easily when the definition of the short circuit mode is close to normal operation of the power supply.

The embodiment of the invention described above eliminates the contradiction that has just been described by making a clear cut separation between the regulation phase and the power supply start up phase, while enabling precise detection of the conditions under which it is sure that a short circuit occurs. These distinctions are made through the action of the first and second switches controlled by the logic circuit 20, and due to the action of the current generator 18 as will be described below.

For a fist value, for example 1, at the output 23 from logic circuit 20, switch 16 is closed and switch 17 is open. Since switch 16 is closed, the capacitor 6 charges under the effect of the current generator 18, however since switch 17 is open, the driver stage 7 does not receive any control signal and consequently, output 8 from this driver stage does not open the power stage 2 such that this stage is closed. This first characteristic enables the circuit to start up when switching on.

While the capacitor 6 is being charged, the voltage at the input 19 to circuit 1 increases, the difference between the nominal voltage and the real voltage reduces, cancels itself out and then increases. Consequently, the "probe" signal present at the output 10 from the control stage 11 of driver stage 7 increases quickly with a steep rising front and at a given moment this difference received on the second input 22 to the logic circuit 20 exceeds the first threshold voltage received on the first input 21 to logic circuit 20. This change to a higher value changes the value present on the output 23 from the logic circuit. Under these conditions, switch 16 opens and switch 17 closes. In these switch positions, circuit 1 and the power stage 2 operate in a known manner as in prior art.

However, if the signal received on the fourth input 25 to the logic circuit 20 becomes less than the value of the threshold voltage received on the third input 24 to logic circuit 20, which denotes a short circuit or an excessive current demand, switch 17 opens and the power stage 2 is no longer powered and therefore closes. Switch 16 opens and the input current is limited even in the case of a short circuit to the value of the current output by the current generator 18. Consequently, it can be seen that the output voltage from the power stage 2 can be controlled in a reliable manner, while guaranteed to remain above a predetermined threshold.

Figure 2:
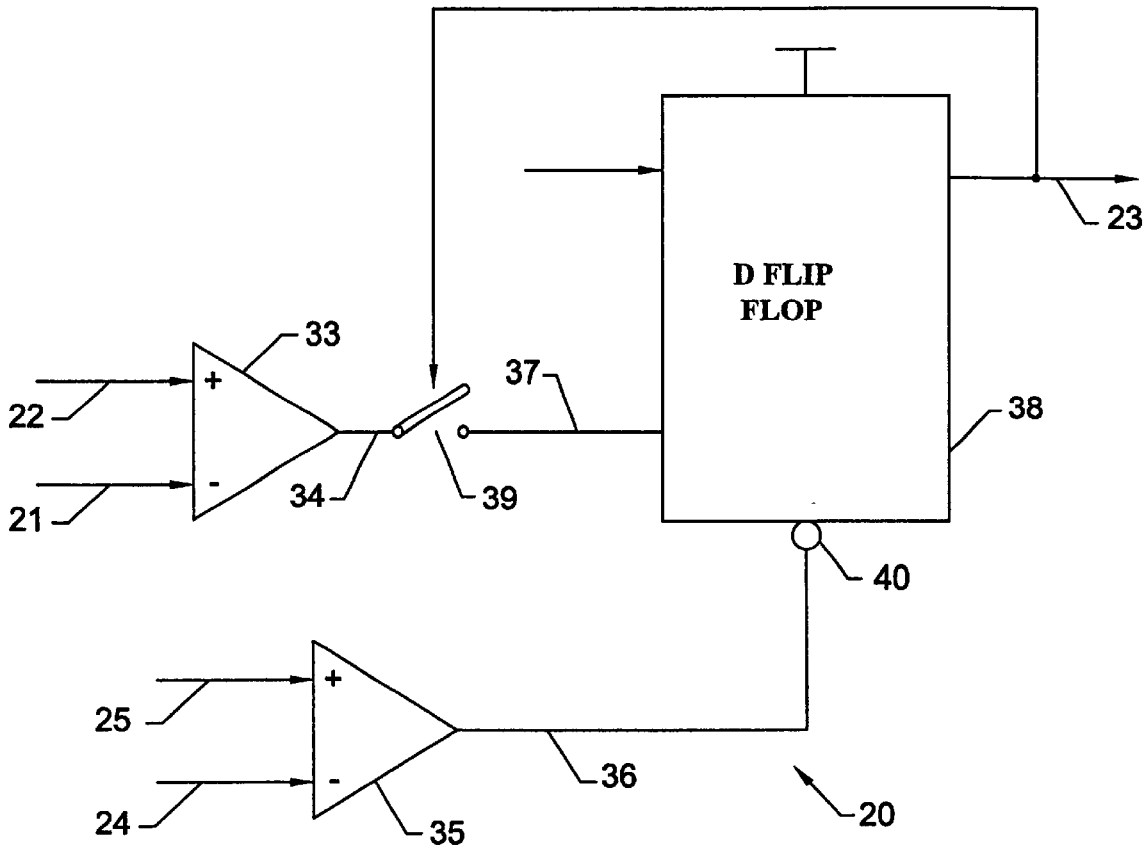
FIG. 2 is an example of a logic circuit used in an embodiment of the invention.

The operation of an example embodiment of the logic circuit 20 will now be described, with respect to FIG. 2 which shows a functional diagram of this type of circuit. The logic circuit 20 shown in FIG. 2 comprises a first comparator 33 with two inputs 21, 22 comprising the first and second inputs to logic circuit 20, respectively. Note that a first threshold voltage is applied to one of these two inputs, and a signal representing a difference between a nominal value of the output voltage from the power stage and a real value of this voltage output from the power stage 2 (in this case, this is the "probe" signal present at the output from the control stage 11 of the driver stage 7) is applied to the other.

The comparator output 34 is coupled through a deactivation device 39 to a clk input 37 of a reinitializable D flip flop 38. The logic circuit 20 shown in FIG. 2 also comprises a second comparator 35 with two inputs 24, 25, forming the third and fourth inputs respectively to the logic circuit 20. Note that a second threshold voltage is applied to one of these two inputs, and a voltage representing the output voltage from power stage 2 (in the example embodiment described herein, equal to the value of the output voltage) is applied to the other.

The output 36 from the second comparator 35 is coupled to a reinitialization input 40 of the D flip flop 38. The output 23 from the D flip flop 38 becomes the output 23 from logic circuit 20. The output 23 is coupled to the deactivation device 39.

Figure 3:
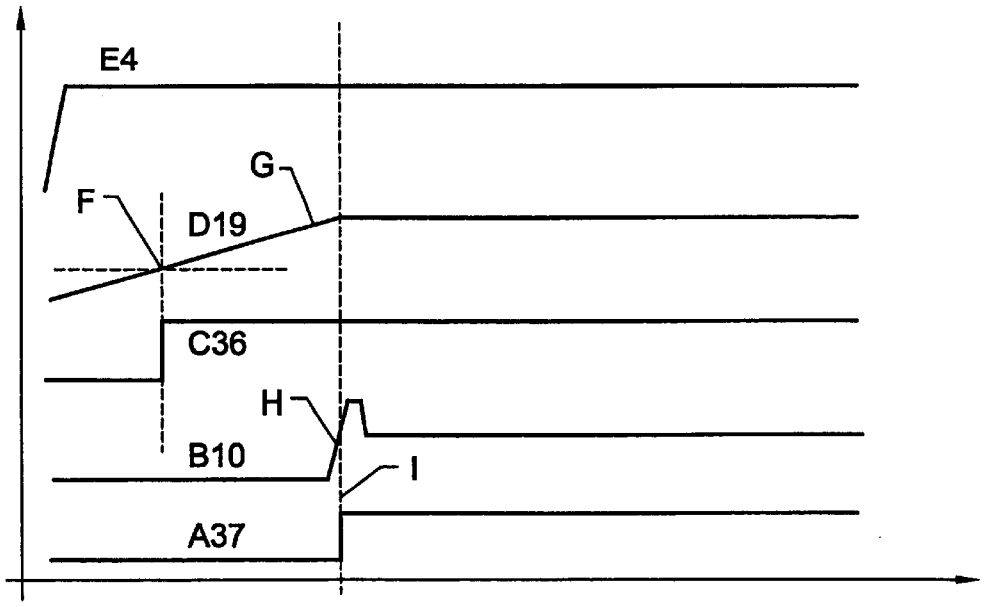
FIG. 3 is a set of curves drawn to the same time scale and which show the main transition phases of the various signals at the time of start up.

The operation of this circuit 20 with respect to curves A37, B10, C36, D19 and E4 shown in FIG. 3, will now be discussed. Curve A37 represents the value of the signal at the clk input 37 to the D flip flop 38. Curve B10 shows the value of the "probe" signal at the input 21 to the first comparator 33. Reference 10 is shown as a reminder that this signal is available on the output 10 from stage 11. Curve C36 represents the value of the signal at the reinitialization input 40 of the D flip flop 38. Curve D19 represents the value of the signal at the input 25 to the second comparator 35. Reference 19 is shown as a reminder that this signal is available on the input 19 to the control and regulation circuit 1. Finally, curve E4 represents the value of the unregulated power supply voltage to the power stage 2. Reference 4 is shown as a reminder that this signal is available on the input 4 to the power stage 2.

These five curves show the variation with time of the value of the signal that they represent immediately after the power supply was switched on. Curve E shows that the unregulated power supply voltage reaches its nominal value almost immediately. On curve D, the regulated voltage increases almost linearly to its nominal value following the rise in voltage across capacitor 6 which is charged continuously under the action of the current generator 18. When this voltage at the input 25 to comparator 35 reaches point F on the curve, the threshold value present at input 24, the reinitialization signal is triggered as shown by a step on curve C36. This does not change the first output value from the D flip flop 38 at output 23, since this value was already present. Consequently, the positions of switches 16 and 17 are not modified.

When the regulated output voltage approaches the nominal output voltage, as shown at point G on curve D, the regulation loop which is then open, reacts by pulling the value of the "probe" signal upwards. Stage 11 is a high impedance, high gain stage of the regulation loop which very quickly changes from a low voltage to a higher voltage as soon as the regulated output from the power stage exceeds the nominal value. This will result in a very steep rising front as shown at H on curve B. This steep rising front of the signal at input 22 to comparator 33 will change the comparator output value and therefore switchover the D flip flop 38 as shown at I on curve A.

The return loop from output 23 on the deactivation device 39 will prevent another switchover due to any subsequent variations in the "probe" signal. It can thus be seen that the choice of the difference signal at the output from the first amplifier 11 from the regulation loop can cause a well defined switchover of the D flip flop 38, due to the nature of the generated signal. Note that it is not necessary to have the two switches 16 and 17, depending on the embodiment of the regulation loop and particularly the number of connections available at the output from the integrated regulation circuit, or depending on the expected performances of the power supply and particularly the separation between authorized and prohibited current ranges. In this case, switch 16 enables the regulation loop to start independently due to switch 17 which is open at the time of start up.

Switch 17 would not be necessary if the charging current were too low corresponding to a very slow voltage rise, due to the characteristics of the regulated power supply. In this case, the generator 18 is only useful to accelerate start up. Similarly, if capacitor 6 can be charged with a sufficiently low current while remaining conform with the start up time, switch 16 and the current generator 18 would not be necessary.

In the example shown in FIG. 1, switch 17 also cuts off the power supply in the case of a short circuit. This function can be provided independently of whether or not switch 16 and the current generator 18 are present. The two switches become necessary when the normal switching on current is similar to or greater than the short circuit current and when the start up current is close to the short circuit current.

That which is claimed is:

1. A control and regulation circuit for a regulated DC power supply including a power stage with a control input, an input for an unregulated power supply DC voltage, an output for the regulated DC voltage, and a decoupling capacitor connected between a reference potential and the output, for a regulated and gradual increase in voltage, the control and regulation circuit comprising:

a control and regulation loop having an input for connection to the output of the power stage and an output for connection to the control input of the power stage, the control and regulation loop comprising a first controllable switch, a current generator connectable to the input of the control and regulation loop via the first controllable switch, and a logic circuit for controlling the first controllable switch, the logic circuit including a first input for receiving a first threshold voltage, a second input for receiving a signal representing a difference between a nominal value of the output regulated DC voltage from the power stage and a real value of the output regulated DC voltage from the power stage, the logic circuit generating a first value corresponding to a closed position of the first controllable switch such that the decoupling capacitor is charged by the current generator, the first value being present as long as a value of the signal representing the difference between the nominal value of the output regulated DC voltage from the power stage and the real value of the output regulated DC voltage from the power stage received at the second input of the logic circuit is less than the value of the first threshold voltage received at the first input to the logic circuit, the logic circuit generating a second value corresponding to an open position of the first controllable switch when the value of the signal representing the difference between the nominal value of the output regulated DC voltage from the power stage and the real value of the output regulated DC voltage from the power stage is greater than the value of the first threshold voltage.

2. A circuit according to claim 1, wherein the control and regulation loop further comprises a second controllable switch for connecting the control and regulation loop to the power stage, and being controlled by the logic circuit, the second controllable switch being in an open position to disconnect the power stage from the control and regulation loop when the first value from the logic circuit is present, and the second controllable switch being in a closed position to connect the power stage to the control and regulation loop when the second value from the logic circuit is present.

3. A circuit according to claim 2, wherein the logic circuit includes a third input for receiving a second threshold voltage, and a fourth input for receiving the output regulated DC voltage, and wherein the logic circuit generates a first output value to control the first controllable switch into the closed position and the second controllable switch into the open position when the output regulated DC voltage is less than the second threshold voltage.

4. A circuit according to claim 3, wherein the control and regulation loop further comprises:

a driver stage having an output connected to the control input of the power stage, and an input for receiving a probe signal representing a difference between a nominal output value of the output regulated DC voltage and a real output value of the output regulated DC voltage;

a control stage for outputting the probe signal to the input of the driver stage, the control stage having an input for receiving an error signal; and a reference voltage generator for generating the error signal to the input of the control stage, and having an input for receiving a fraction of the output regulated DC voltage equal to a reference voltage when the real output value is equal to the nominal output value.

5. A circuit according to claim 3, wherein the logic circuit comprises:

a first comparator having first and second inputs defining the first and second inputs to the logic circuit respectively;

a flip flop having a first input connected to an output of the first comparator, and an output defining the output from the logic circuit; and a second comparator having first and second inputs defining the third and fourth inputs to the logic circuit respectively, and an output connected to an initialization input of the flip flop.

6. A circuit according to claim 5, wherein the output of the logic circuit is connected to a switch for deactivating the first input of the flip flop connected between the output of the first comparator and the first input of the flip flop.

7. A circuit according to claim 2, wherein the control and regulation loop further comprises:

a driver stage having an output connected to the control input of the power stage and an input for receiving a probe signal representing a difference between a nominal output value of the output regulated DC voltage and a real output value of the output regulated DC voltage;

a control stage for outputting the probe signal to the input of the driver stage the control stage having an input for receiving an error signal; and a reference voltage generator for generating the error signal to the input of the control stage, and having an input for receiving a fraction of the output regulated DC voltage equal to a reference voltage when the real output value is equal to the nominal output value.

8. A circuit according to claim 7, wherein the second controllable switch is connected between an output of the control stage of the driver stage and the input of the driver stage.

9. A circuit according to claim 1, wherein the logic circuit comprises:

a first comparator having first and second inputs defining the first and second inputs of the logic circuit respectively, and an output and a flip flop having a first input connected to the output of the first comparator, and an output defining the output of logic circuit.

10. A circuit according to claim 9, wherein the output of the logic circuit is connected to a switch for deactivating the first input of the flip flop connected between the output of the first comparator and the first input of the flip flop.

11. A control and regulation circuit for a regulated DC power supply including a power stage with a control input, an input for an unregulated power supply DC voltage, an output for the regulated DC voltage, and a decoupling capacitor connected between a reference potential and the output, for a regulated and gradual increase in voltage, the control and regulation circuit comprising:

a driver stage having an output connected to the control input of the power stage and an input for receiving a probe signal representing a difference between a nominal output value of the output regulated DC voltage and a real output value of the output regulated DC voltage;

a control stage for outputting the probe signal to the input of the driver stage the control stage having an input for receiving an error signal;

a reference voltage generator for generating the error signal to the input of the control stage, and having an input for receiving a fraction of the output regulated DC voltage equal to a reference voltage when the real output value is equal to the nominal output value;

an input of the control and regulation circuit for connection between the output of the power stage and the decoupling capacitor;

a current generator connectable to the input of the control and regulation circuit;

a first controllable switch for connecting the current generator to the input of the control and regulation circuit;

a second controllable switch for connecting the output of the control stage of the driver stage to the input of the driver stage; and a logic circuit for controlling the first and second controllable switches, the logic circuit including a first input for receiving a first threshold voltage, and a second input for receiving the probe signal, the logic circuit generating a first value corresponding to a closed position of the first controllable switch such that the decoupling capacitor is charged by the current generator and corresponding to an open position of the second controllable switch to disconnect the output of the control stage of the driver stage to the input of the driver stage, the first value being present as long as the probe signal is less than the first threshold voltage received at the first input of the logic circuit the logic circuit generating a second value corresponding to an open position of the first controllable switch and a closed position of the second controllable switch to connect the output of the control stage of the driver stage to the input of the driver stage when the probe signal is greater than the first threshold voltage.

12. A circuit according to claim 11, wherein the logic circuit includes a third input for receiving a second threshold voltage, and a fourth input for receiving the output regulated DC voltage, and wherein the logic circuit generates a first output value to control the first controllable switch into the closed position and the second controllable switch into the open position when the output regulated DC voltage is less than the second threshold voltage.

13. A control and regulation circuit for a regulated DC power supply including a power stage with a control input, an input for an unregulated power supply DC voltage, an output for the regulated DC voltage, and a decoupling capacitor connected between a reference potential and the output, the control and regulation circuit comprising:

a control and regulation loop having an input for connection to the output of the power stage and an output for connection to the control input of the power stage, the control and regulation loop comprising a first controllable switch, a current generator connectable to the input of the control and regulation loop via the first controllable switch, and a logic circuit for receiving a first threshold voltage and a probe signal and for controlling the first controllable switch to close such that the decoupling capacitor is charged by the current generator when the probe signal is less than the first threshold voltage, and for controlling the first controllable switch to open when the probe signal is greater than the first threshold voltage.

14. A circuit according to claim 13, wherein the probe signal represents a difference between a nominal value of the output regulated DC voltage from the power stage and a real value of the output regulated DC voltage from the power stage.

15. A circuit according to claim 13, wherein the control and regulation loop further comprises a second controllable switch for connecting the control and regulation loop to the power stage, the second controllable switch being controllable by the logic circuit to disconnect the power stage from the control and regulation loop when the probe signal is less than the first threshold voltage, and to connect the power stage to the control and regulation loop when the probe signal is greater than the first threshold voltage.

16. A circuit according to claim 15, wherein the logic circuit also receives a second threshold voltage and the output regulated DC voltage, and wherein the logic circuit closes the first controllable switch and opens the second controllable switch when the output regulated DC voltage is less than the second threshold voltage.

17. A circuit according to claim 16, wherein the control and regulation loop further comprises:

a driver stage having an output connected to the control input of the power stage and an input for receiving the probe signal;

a control stage for outputting the probe signal to the input of the driver stage the control stage having an input for receiving an error signal; and a reference voltage generator for generating the error signal to the input of the control stage, and having an input for receiving a fraction of the output regulated DC voltage equal to a reference voltage when the real output value is equal to the nominal output value.

18. A circuit according to claim 16, wherein the logic circuit comprises:

a first comparator for receiving the first threshold voltage and the probe signal;

a second comparator for receiving the second threshold voltage and the output regulated DC voltage;

a flip flop for receiving an output of the first comparator at a first input, and for receiving an output of the second comparator at an initialization input.

19. A circuit according to claim 18, wherein the logic circuit further comprises a switch controlled by an output of the logic circuit for deactivating the first input of the flip flop.

20. A circuit according to claim 15, wherein the control and regulation loop further comprises:

a driver stage having an output connected to the control input of the power stage and an input for receiving the probe signal;

a control stage for outputting the probe signal to the input of the driver stage the control stage having an input for receiving an error signal; and a reference voltage generator for generating the error signal to the input of the control stage, and having an input for receiving a fraction of the output regulated DC voltage equal to a reference voltage when the real output value is equal to the nominal output value.

21. A circuit according to claim 20, wherein the second controllable switch is connected between an output of the control stage and the input of the driver stage.

22. A circuit according to claim 13, wherein the logic circuit comprises:

a first comparator for receiving the first threshold voltage and the probe signal; and a flip flop for receiving an output of the first comparator at a first input.

23. A circuit according to claim 22, wherein an output of the logic circuit is connected to a switch for deactivating the first input of the flip flop.

24. A control and regulation circuit for a regulated DC power supply including a power stage with a control input, an input for an unregulated power supply DC voltage, an output for the regulated DC voltage, and a decoupling capacitor connected between a reference potential and the output, the control and regulation circuit comprising:

a driver stage connected to the control input of the power stage and for receiving a probe signal;

a control stage for outputting the probe signal to the driver stage and for receiving an error signal;

a reference voltage generator for generating the error signal to the control stage, and for receiving a fraction of the output regulated DC voltage equal to a reference voltage when the real output value is equal to the nominal output value;

an input of the control and regulation circuit for connection between the output of the power stage and the decoupling capacitor;

a current generator connectable to the input of the control and regulation circuit;

a first controllable switch for connecting the current generator to the input of the control and regulation circuit;

a second controllable switch for connecting the control stage to the driver stage; and a logic circuit for receiving a first threshold voltage and the probe signal and for controlling the first and second controllable switches, the logic circuit closing the first controllable switch so that the decoupling capacitor is charged by the current generator and opening the second controllable switch to disconnect the control stage from the driver stage, when the probe signal is less than the first threshold voltage, the logic circuit opening the first controllable switch and closing the second controllable switch to connect the control stage to the driver stage, when the probe signal is greater than the first threshold voltage.

25. A circuit according to claim 24, wherein the probe signal represents a difference between a nominal value of the output regulated DC voltage from the power stage and a real value of the output regulated DC voltage from the power stage.

26. A circuit according to claim 24, wherein the logic circuit receives a second threshold voltage and the output regulated DC voltage, and wherein the logic circuit closes the first controllable switch and opens the second controllable switch when the output regulated DC voltage is less than the second threshold voltage.

27. A regulated DC power supply comprising:

a power stage having a control input, an input for an unregulated power supply DC voltage, an output for a regulated DC voltage, and a decoupling capacitor connected between a reference potential and the output; and a control and regulation loop having an input connected to the output of the power stage and an output connected to the control input of the power stage, the control and regulation loop comprising a first controllable switch, a current generator connectable to the input of the control and regulation loop via the first controllable switch, and a logic circuit for receiving a first threshold voltage and a probe signal and for controlling the first controllable switch to close such that the decoupling capacitor is charged by the current generator when the probe signal is less than the first threshold voltage, and for controlling the first controllable switch to open when the probe signal is greater than the first threshold voltage.

28. A regulated DC power supply according to claim 27, wherein the probe signal represents a difference between a nominal value of the output regulated DC voltage from the power stage and a real value of the output regulated DC voltage from the power stage.

29. A regulated DC power supply according to claim 27, wherein the control and regulation loop further comprises a second controllable switch for connecting the control and regulation loop to the power stage, the second controllable switch being controllable by the logic circuit to disconnect the power stage from the control and regulation loop when the probe signal is less than the first threshold voltage, and to connect the power stage to the control and regulation loop when the probe signal is greater than the first threshold voltage.

30. A regulated DC power supply according to claim 29, wherein the logic circuit also receives a second threshold voltage and the output regulated DC voltage, and wherein the logic circuit closes the first controllable switch and opens the second controllable switch when the output regulated DC voltage is less than the second threshold voltage.

31. A regulated DC power supply according to claim 30, wherein the control and regulation loop further comprises:

a driver stage having an output connected to the control input of the power stage and an input for receiving the probe signal;

a control stage for outputting the probe signal to the input of the driver stage the control stage having an input for receiving an error signal; and a reference voltage generator for generating the error signal to the input of the control stage, and having an input for receiving a fraction of the output regulated DC voltage equal to a reference voltage when the real output value is equal to the nominal output value.

32. A regulated DC power supply according to claim 30, wherein the logic circuit comprises:

a first comparator for receiving the first threshold voltage and the probe signal;

a second comparator for receiving the second threshold voltage and the output regulated DC voltage;

a flip flop for receiving an output of the first comparator at a first input, and for receiving an output of the second comparator at an initialization input.

33. A regulated DC power supply according to claim 32, wherein the logic circuit further comprises a switch controlled by an output of the logic circuit for deactivating the first input of the flip flop.

34. A regulated DC power supply according to claim 29, wherein the control and regulation loop further comprises:

a driver stage having an output connected to the control input of the power stage and an input for receiving the probe signal;

a control stage for outputting the probe signal to the input of the driver stage the control stage having an input for receiving an error signal; and a reference voltage generator for generating the error signal to the input of the control stage, and having an input for receiving a fraction of the output regulated DC voltage equal to a reference voltage when the real output value is equal to the nominal output value.

35. A regulated DC power supply according to claim 34, wherein the second controllable switch is connected between an output of the control stage and the input of the driver stage.

36. A regulated DC power supply according to claim 27, wherein the logic circuit comprises:

a first comparator for receiving the first threshold voltage and the probe signal; and a flip flop for receiving an output of the first comparator at a first input.

37. A regulated DC power supply according to claim 36, wherein an output of the logic circuit is connected to a switch for deactivating the first input of the flip flop.

38. A method of using a control and regulating loop to control and regulate a DC power supply including a power stage with a control input, an input for an unregulated power supply DC voltage, an output for a regulated DC voltage, and a decoupling capacitor connected between a reference potential and the output, the control and regulation loop comprising a first controllable switch, a current generator connectable to the input of the control and regulation loop via the first controllable switch, and a logic circuit for controlling the first controllable switch, the method comprising the steps of:

connecting an input of the control and regulation loop to the output of the power stage and connecting an output of the control and regulation loop to the control input of the power stage;

providing a first threshold voltage and a probe signal to the logic circuit;

charging the decoupling capacitor with the current generator by controlling the first controllable switch to close when the probe signal is less than the first threshold voltage; and controlling the first controllable switch to open when the probe signal is greater than the first threshold voltage.

39. A method according to claim 38, wherein the probe signal represents a difference between a nominal value of the output regulated DC voltage from the power stage and a real value of the output regulated DC voltage from the power stage.

40. A method according to claim 38, wherein the control and regulation loop further comprises a second controllable switch for connecting the control and regulation loop to the power stage, the second controllable switch being controllable by the logic circuit, and further comprising the steps of:

disconnecting the power stage from the control and regulation loop when the probe signal is less than the first threshold voltage; and connecting the power stage to the control and regulation loop when the probe signal is greater than the first threshold voltage.

41. A method according to claim 40, further comprising the steps of:

providing the logic circuit with a second threshold voltage and the output regulated DC voltage; and closing the first controllable switch and opening the second controllable switch when the output regulated DC voltage is less than the second threshold voltage.

42. A method according to claim 41, wherein the control and regulation loop further comprises:

a driver stage having an output connected to the control input of the power stage and an input for receiving the probe signal;

a control stage for outputting the probe signal to the input of the driver stage the control stage having an input for receiving an error signal; and a reference voltage generator for generating the error signal to the input of the control stage, and having an input for receiving a fraction of the output regulated DC voltage equal to a reference voltage when the real output value is equal to the nominal output value.

43. A method according to claim 41, wherein the logic circuit comprises:

a first comparator for receiving the first threshold voltage and the probe signal;

a second comparator for receiving the second threshold voltage and the output regulated DC voltage;

a flip flop for receiving an output of the first comparator at a first input, and for receiving an output of the second comparator at an initialization input.

44. A method according to claim 43, wherein the logic circuit further comprises a switch controlled by an output of the logic circuit for deactivating the first input of the flip flop.

45. A method according to claim 40, wherein the control and regulation loop further comprises:

a driver stage having an output connected to the control input of the power stage and an input for receiving the probe signal;

a control stage for outputting the probe signal to the input of the driver stage the control stage having an input for receiving an error signal; and a reference voltage generator for generating the error signal to the input of the control stage, and having an input for receiving a fraction of the output regulated DC voltage equal to a reference voltage when the real output value is equal to the nominal output value.

46. A method according to claim 45, wherein the second controllable switch is connected between an output of the control stage and the input of the driver stage.

47. A method according to claim 38, wherein the logic circuit comprises:

a first comparator for receiving the first threshold voltage and the probe signal; and a flip flop for receiving an output of the first comparator at a first input.

48. A method according to claim 47, wherein an output of the logic circuit is connected to a switch for deactivating the first input of the flip flop.

* * * * *

UNITED STATES PATENT AND TRADEMARK OFFICE

CERTIFICATE OF CORRECTION

PATENT NO. : 6,252,385 B1
DATED : June 26, 2001
INVENTOR(S) : Pascal Mellot

It is certified that error appears in the above-identified patent and that said Letters Patent is hereby corrected as shown below:

Column 6,
Line 50, delete "conform" insert -- conformed --

Column 8,
Line 26, delete "the driver stage the control stage" insert -- the driver stage, the control stage --
Line 45, delete "of logic circuit." insert -- of the logic circuit. --

Column 9,
Line 26, delete "the logic circuit the logic" insert -- the logic circuit, the logic --

Column 10,
Line 22, delete "the driver stage the control stage" insert -- the driver stage, the control stage --
Line 49, delete "the driver stage the control stage" insert -- the driver stage, the control stage --

Column 14,
Line 8, delete "the driver stage the control stage" insert -- the driver stage, the control stage --
Line 36, delete "the driver stage the control stage" insert -- the driver stage, the control stage --

Signed and Sealed this

Fourteenth Day of May, 2002

*Attest:*

*Attesting Officer*

JAMES E. ROGAN
*Director of the United States Patent and Trademark Office*